United States Patent [19]

Smith et al.

[11] 4,088,891

[45] May 9, 1978

[54] ELECTROSTATIC APERTURE PRINTING

[75] Inventors: R. Lowell Smith, Solon, Ohio; J. Douglas Logan, Canoga Park; Michael P. Kendall, Chatsworth, both of Calif.

[73] Assignee: Horizons Research Incorporated, Cleveland, Ohio

[21] Appl. No.: 740,919

[22] Filed: Nov. 11, 1976

[51] Int. Cl.[2] ..... G03G 13/00; G03G 15/00

[52] U.S. Cl. ..... 250/315 R; 101/DIG. 13

[58] Field of Search ..... 101/DIG. 13; 250/315 R

[56] References Cited

U.S. PATENT DOCUMENTS

| | | | |
|---|---|---|---|
| 3,257,222 | 6/1966 | Carlson | 101/DIG. 13 |
| 3,335,322 | 8/1967 | Epstein et al. | 101/DIG. 13 |
| 3,362,325 | 1/1968 | Foster | 101/DIG. 13 |
| 3,438,053 | 4/1969 | Howell | 250/315 |
| 3,961,574 | 6/1976 | Fotland | 101/DIG. 13 |

*Primary Examiner*—Alfred E. Smith
*Assistant Examiner*—T. N. Grigsby
*Attorney, Agent, or Firm*—Lawrence I. Field

[57] ABSTRACT

An electrostatic aperture printer employing a gating mask placed between a source of ions and a charge receiving member to generate imagery consisting of aggregations of elemental dots or line segments formed in response to electronic control signals wherein the improvement lies in electrically biasing the mask or mask segments in such a way that the functions of ion collection and control are combined in the region between the mask and a charge receptor backing electrode via the establishment of appropriate transmission or blocking fields. Further electrostatic printing improvements incorporated are the development of useful charge receptor holddown forces via static or rolling backing electrode structures designed to make constructive use of the longitudinal tension normally developed in receptor web handling, and enhanced ion transmission achieved by means of shaped aplanar mask structures incorporating zones fabricated from insulating material.

13 Claims, 19 Drawing Figures

FIG.3.
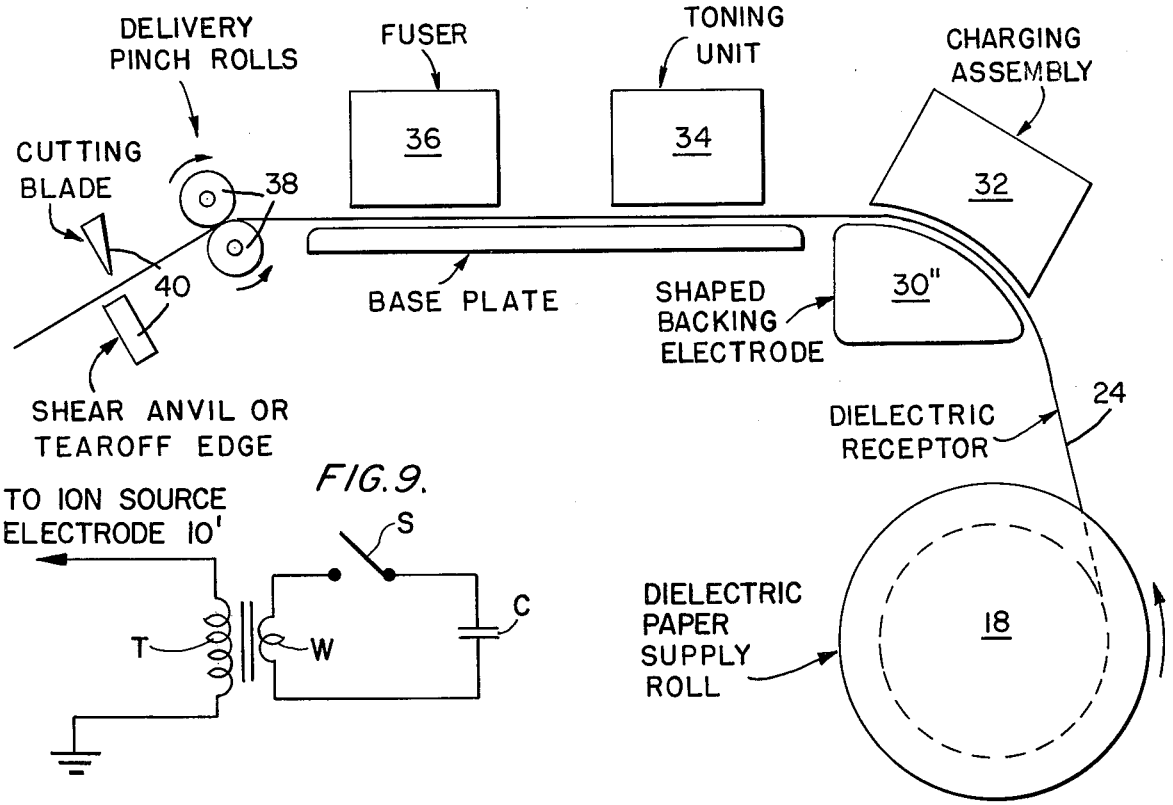
FIG.9.
FIG.4.
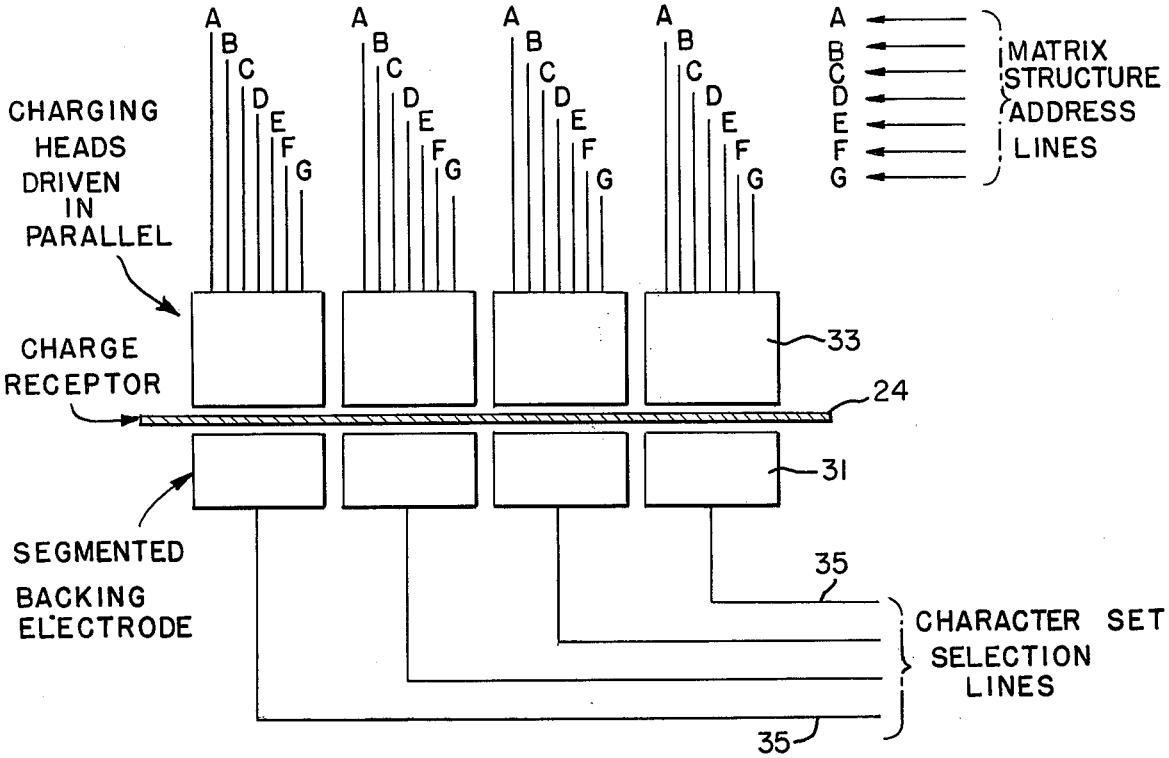

ELECTROSTATIC APERTURE PRINTING

This invention relates to improved image generation in the field of electrostatic printing. Electrostatic printing is a very broad field including such diverse elements as xerography, electrography, matrix printing with nominally contacting styli, ink jet printing, stencil and aperture printing using corona or arc sources, and the like. The present invention includes novel ways of gating and shaping the flow of source ions to form an electrostatic charge image on an insulating receptor surface. Such an image is rendered visible by any of a number of conventional development procedures, and fixed or fused to generate a semipermanent graphic record.

The patent literature contains many hundreds of descriptions of procedures, techniques, and devices associated with the practice of the electrostatic printing art. Many of these constitute the basis for commercial hardware in the field. In order to appreciate the advantages of the present invention, it is desirable to consider the characteristics of certain related electrostatic image forming methods.

An apparatus for generating matrix format charge images representing alphanumeric characters is described by Babaoff in U.S. Pat. No. 3,599,225 issued Aug. 1971. Character structure elements are produced by shaping corona emission by means of apertures in an electrically insulating or dielectric mask. There is a separate extended corona emitter for each of the several rows of printed spots characteristic of matrix printing. Forming only those charge image elements corresponding to the desired graphic output is accomplished by the appropriate temporal excitation of the corona sources. Another aperture printing system is presented by Foster in U.S Pat. No. 3,314,360 issued Apr. 1967. This involves shaping the output of a plurality of arc discharge ion sources with a metallic, electrically conducting mask configured in the form of an endless belt carrying several full stencil character sets. In both of the above patents the primary modulation or act of impressing information on the receptor surface involves turning on or exciting the ion sources. Yet another aperture printing technique is described by Fotland in U.S. Pat. No. 3,961,574 issued June 8, 1976, utilizing a corona source, shaping aperture, and dielectric receptor sheet. In this method a slotted mask is employed and corona excitation is coordinated with dielectric paper motion to produce a sequence of variable width bars. Again ion modulation is achieved an on and off switching of the corona source itself. High voltage switching requirements are reduced by employing subthreshold biasing, e.g. by the superimposition of a static bias below the threshold of corona generation and relatively small amplitude print pulses. To summarize, all three of the above described electrostatic printing techniques have in common the structural features of a source of ions, a shaping mask, and a dielectric ion receiving member backed by a conductive platen. Another feature that these methods all exhibit is that charge image generation is initiated by activating the ion source. With a corona source this generally implies a high voltage switching requirement for which special vacuum tubes or cascaded sets of transistors are needed.

One object of the present invention is to provide electrostatic printing means which can be operated using simple, low voltage control circuits.

The present invention relates primarily to improvements in electrostatic printing and particularly in the way a conducting mask is configured and electrically operated to achieve a very positive control over the projection of ions from an ion source to a charge receiving member. The invention will be more readily understood by referring to the drawings in which:

FIG. 3 is a schematic layout of a fully articulated electrostatic printer incorporating the novel charge image generation of this invention;

FIG. 4 depicts a charging assembly having a segmented backing electrode which permits a multiplexed mode of operation;

FIG. 9 is a schematic view of one form of ion generating means.

Figure 1:
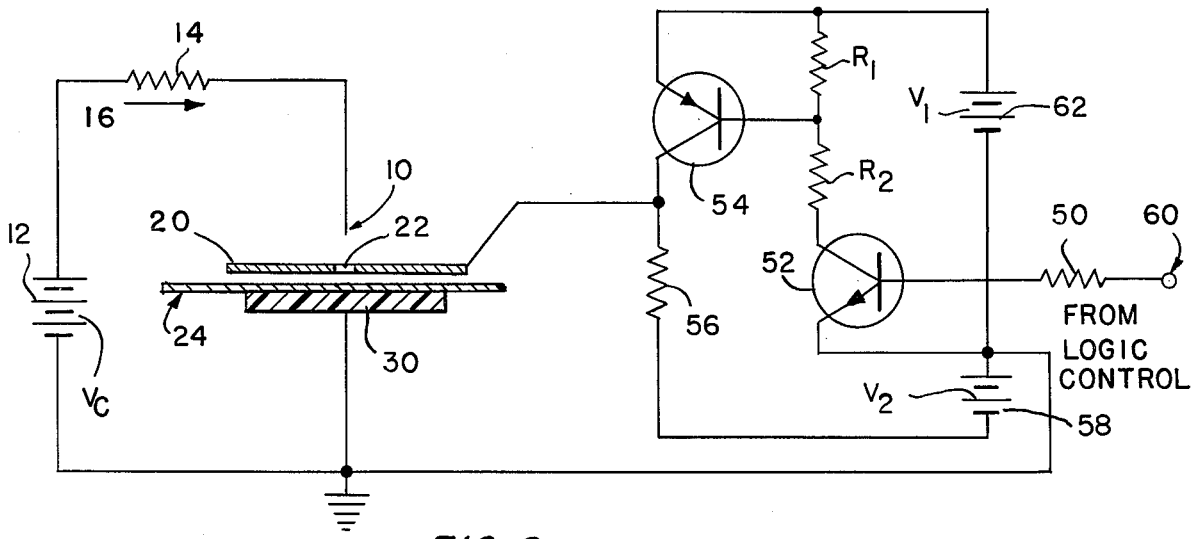
FIG. 1 is a simplified schematic cross-sectional view of an aperture printing assembly and a control mask switching circuit.

Referring first to FIG. 1 which shows the basic operating characteristics of the present invention, a corona emitting member 10 is connected to a voltage source (which develops an output potential difference $V_c$) through a resistor 14. This gives rise to a corona current 16 which flows either entirely to a control mask 20 or mostly to mask 20 and partially through an aperture 22 in mask 20 to a charge receptor 24 comprising a moderately conducting base layer and a thin insulating layer bonded thereto. Whether or not an ion (corona) current reaches receptor 24 depends on the control potential applied to mask 20. By way of example, potential 12 is assumed to be positive and positive ions are assumed to be generated by corona emitting member 10. If the control mask 20 is now biased more negative than a backing electrode 30, an electric field is established between mask 20 and backing electrode 30, tending to sweep positive ions in the interelectrode region away from the surface of receptor 24 toward the mask 20 where they are collected. No ion current reaches the receptor sheet or web 24 in this case. Suppose now that the mask 20 is made more positive than backing electrode 30. In this case the interelectrode electric field between the mask and the backing electrode is directed so as to effect the transport of positive ions toward the backing electrode. As a result, those ions which initially find their way through the mask aperture 22 are collected at the insulating receptor film 24 and constitute a portion of the charge image to be formed there. Thus viewed together as elements of a coordinated assembly, the mask 20 and backing electrode 30 exhibit a blocking or transmitting effect on the flow of ions depending on their relative potentials.

Switching between the blocking and transmitting states is accomplished by altering the voltage applied to the mask 20 by means of a switching circuit also shown in FIG. 1. When an external control logic signal of zero volts is applied at terminal 60 and coupled through a current limiting resistor 50 to the base of transistor 52, transistors 52 and 54 are turned off and mask 20 is coupled through a resistor 56 to the negative terminal of a voltage source 58 supplying a potential difference $V_2$. When a positive logic signal such as a voltage pulse having an amplitude in the range of 5 to 15 volts is applied to terminal 60, transistors 52 and 54 turn on and mask 20 is coupled to a source of potential difference 62 supplying a voltage $V_1$ through transistor 54. Thus, apart from the slight emitter-to-collector voltage drop across transistor 54 in saturation and the essentially negligible IR drop across resistance 56 when transistor 54 is turned off, the ion modulator mask 20 is switched between the potentials $V_1$ and $-V_2$ with the zero of potential referenced to the backing electrode 30. Potentials $V_1$ and $V_2$ are power supply voltages which may be developed separately or produced simply by standard resistive division using a single floating supply having a voltage output equal to their sum. The potentials $V_1$ and $V_2$ are chosen first to satisy the requirements of ion transmission and blocking as discussed above. In addition to affecting the total number of ions which are drawn through the mask aperture per unit time and attached to the receptor, the potential $V_1$ plays a role in determining the degree of collimation or localization of the ion beam as it impinges on the receptor sheet 24. This focusing effect ultimately manifests itself in the observed sharpness of the developed charge image elements produced. When the ion modulator is gated on, the transmission of charge carriers is determined jointly by $V_1$ and $V_c$ and the corona current limiting resistor 14. Voltage $V_c$ and resistor 14 are chosen to produce convenient primary corona flux levels. Resistor 14 serves as a stabilizing influence on the electrical parameters of corona generation. In the event that a set of several closely spaced ion modulating apertures are operated in concert such as in dot matrix printing, resistors analogous to resistor 14 serve as decoupling resistors and allow all of the corona emitting electrodes to be driven using a single high voltage power supply.

The preceding discussion illustrated the use of positive corona. The ion modulator concept of the present invention is equally applicable to the control of negative ions. With negative corona FIG. 1 and the above discussion are an appropriate description of this situation if the terminal connections of voltage sources 12, 62, and 58 are reversed, the PNP transistor 54 and NPN transistor 52 are interchanged, and the algebraic signs of voltages and charge carriers relevant to the discussion are reversed. Similarly, electrically switching the apertured mask between two bias levels has been described. The ion modulator could also be operated at a plurality of intermediate biasing conditions. This gives rise to a grey-scale rendition characteristic associated with ion throughputs intermediate between full transmission and complete blocking. Furthermore, the mask 20 could be held at a fixed potential and the backing electrode 30 switched. Controlling the transmission of the ion modulator by altering the potential on the backing electrode but not the mask is electrically equivalent to the reverse procedure. The two approaches are closely related embodiments of the same invention, as will be readily apparent.

FIG. 1 is a very schematic representation of the structural elements of the present electrostatic printing invention to which further refinements can be incorporated. It is desirable, for example, to provide means for transporting dielectric paper or other receptor material into and away from the imaging zone. Means for urging the receptor into intimate contact with the backing electrode are also normally provided in order to establish reproducible spatial operating constraints and provide a good electrical connection to the recording medium. The same requirements must be met in the articulation of other electrographic systems including those employing photoconductor as well as dielectric coated papers. Means commonly employed to satisfy these requirements include vacuum belt and holddown provisions. Vacuum transport and holddown methods are discussed in U.S. Pat. No. 3,282,586 issued Nov., 1966 to Schwebel; U.S. Pat. No. 3,198,517 issued Aug., 1965 to Martin, and the Foster and Fotland patents referred to above. Use of vacuum sheet and web handling methods in electrostatic printing contributes to the complexity and cost of the associated equipment. Pumping means together with gas flow directing tubes, channels, or headers are required. Often the vacuum system plays a dominant role in determining the operating noise level of an electrographic machine. It is therefore a further object of the present invention to provide an approach to aperture printing which does not require vacuum handling of the charge receptor.

Figure 2:
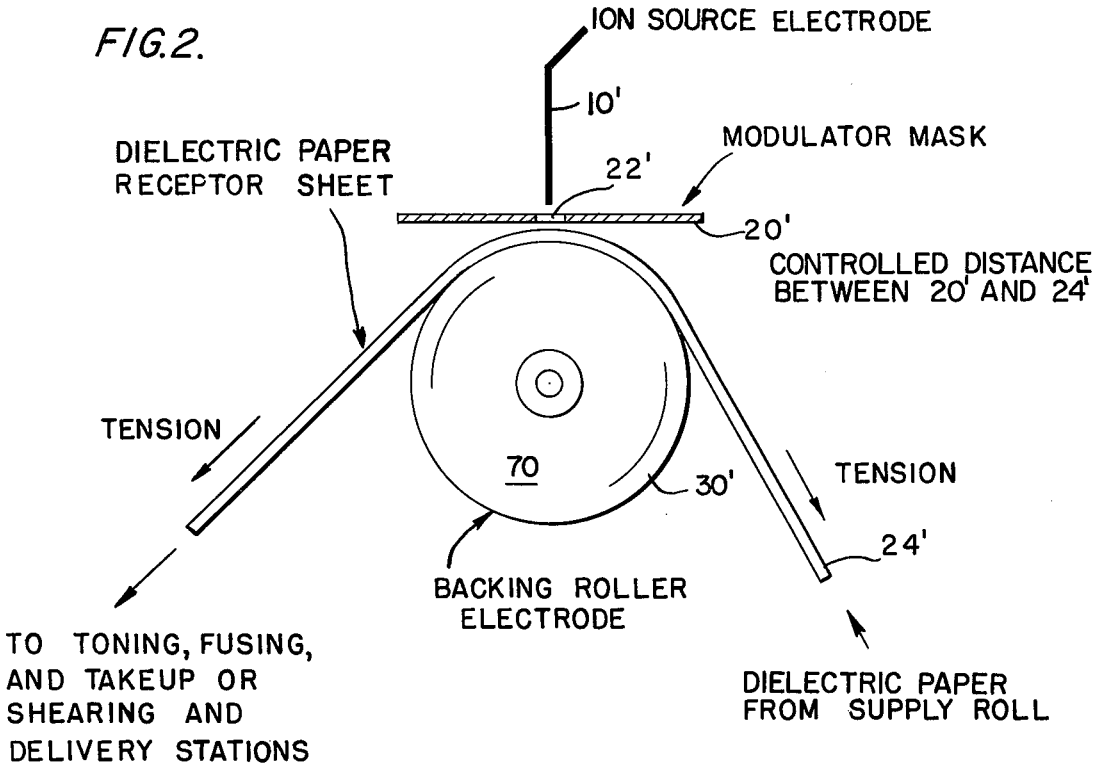
FIG. 2 is a further schematic side elevation of an aperture printer wherein the backing electrode for the charge image receptor web is also a transport roller for this dielectric material.

FIG. 2 shows a modification of the aperture charger of FIG. 1, incorporating a cylindrical metallic roller 70 as a backing electrode 30'. The roller is a part of a transport train for carrying a web of electrographic paper 24'. Not shown in FIG. 2 is the supply spool of receptor material and the image development and fusing means conventional to the electrostatic printing art and placed downstream of the charging zone in the direction of web transport. Web takeup provisions or shearing and strip delivery means are also present in a fully articulated aperture printer. Quite standard hardware such as is represented in FIG. 3 may be utilized for this. Since these ancillary systems are of secondary importance in acquiring an understanding of the salient features of the present invention, they are omitted from FIG. 2. What is essential is that there be provided a wrap zone, a region where the charge receptor web 24' is juxtaposed to and in contact with the backing roller 30'. A wrap exhibiting the desired holddown characteristics is achieved by diverting the web under tension around the backing roller 30' as indicated in FIG. 2. In this case if the tension is distributed uniformly across the width of the web, a uniform holddown pressure $P = 2T/DW$ is developed where $T$ is the total web tension, $D$ is the diameter of the backing roller, and $W$ is the web width. $P$ is constant in magnitude over the entire wrap area and is always perpendicular to the surface of the backing roller and directed toward its geometrical axis. Equivalent electrical performance of the ion modulator and receptor web confinement characteristics can be even more simply achieved by substituting for the roller 30' shown in FIG. 2 a conducting web backing bar 30'' having positive cylindrical curvature, e.g. as shown in FIG. 3. In either case the geometry of the receptor web wrap zone is such as to facilitate the generation of charge image structure elements across the full web width. This may be done using a linear array of apertured masks and associated ion sources. A plurality of such arrays could equally well be configured one behind another in the web transport direction and displaced slightly laterally to effect improved coverage of the image format. In the latter case the web charging means taken as a group would be structured as a shoe 32 mated to the zone of web curvature and placed closely adjacent to the zone of web curvature defined by the backing electrode 30'' as shown in FIG. 3.

The selection of which type of backing electrode is employed depends in part on whether or not it is to be segmented for multiplexing purposes. A segmented backing electrode is shown schematically in FIG. 4 in conjunction with a plurality of charging heads in a configuration suitable for multiplexing. Further practical considerations determine whether in a given operating environment a roller or stationary bar backing electrode is to be preferred. The former eliminates sliding web friction and may reduce chaff generation. However, a sliding electrical contact such as a hardened steel ball spring loaded into a shaft detent must be provided. Electrical connection to the stationary backing bar is trivial. On the other hand hardening, polishing, or plating operations may be required to extend its service life under continuous web abrasion.

FIG. 3 is a schematic layout of a complete apparatus for electrostatic aperture printing. As shown therein a dielectric charge receiving web 24 is paid out from a supply roll 18 and passes between a charging assembly 32 and a backing electrode 30'' corresponding to those shown in greater detail in FIGS. 1 and 2. The resulting charge image on the web 24 is rendered visible and fixed as it traverses conventional toning and fusing apparatus 34 and 36. Finally, the web is delivered by pinch rolls 38 to means 40 for severing the copy into individual sheets.

FIG. 4 schematically depicts an aperture charging assembly configured in such a way as to allow the generation of multiline, dot-matrix, alphanumerics using a minimum number of print control signal lines and electronic driver circuits. More specifically a four-level functional decomposition suitable, for example, for printing four-line address labels is depicted. The structure shown in FIG. 4 can be modified to accommodate larger formats by introducing additional charging heads 33 and backing electrode segments 31. Character matrix column structure information is delivered serially on each of seven (one for each character matrix row) control lines labelled A through G in FIG. 4. Parallel gating signals are thus delivered to each of the multiapertured charging heads 33. Which head or heads actually print is determined by whether or not simultaneous enabling pulses are developed on one or more of the character set (row of alphanumerics) selection lines 35. Both the internal gating of the charging heads by the application of control pulses to apertured mask segments and the enabling selection of character sites operate in accordance with the teachings of the present invention. Mask elements and backing electrode segments act simultaneously as ion control electrodes. Assume, for example, that the mask structures are switched between potentials of $-350$ and $-50$ volts while a bias of 0 or $-300$ volts is applied to the backing electrode segments. Positive ion transmission occurs through only those apertures for which the mask segments are biased least negatively, and the backing segments exhibit their more negative state. The system functions just as described above when mask and backing electrode switching was discussed separately except that each electrode type may be viewed as enabling the gating function of the other.

As a practical matter the identical charging heads 33 of FIG. 4 may be displaced slightly in the receptor web transport direction to compensate for the receptor displacements that occur during the time between successive column structure gating pulses. This time scale and the degree to which the multiplexing technique can be extended depend on the time required to form a single charge image structure element spot, the overall size of the matrix characters and their structural format, and the desired receptor velocity or finished product instantaneous delivery rate. One can expect to service 5 to 50 charging heads per set of drivers by multiplexing if corona sources are employed. Use of arc sources activated by means of standard pulse transformer techniques should allow this performance to be improved upon by about two orders of magnitude.

Figure 5A:
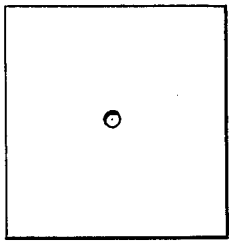
FIGS. 5A through 5F show a number of forms of ion gating masks.
Figure 5B:
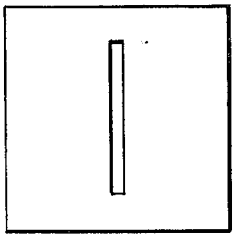
Figure 5C:
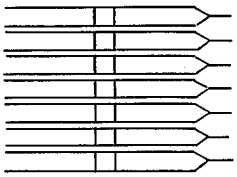
Figure 5D:
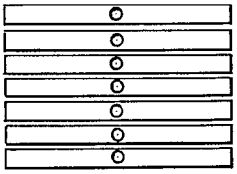
Figure 5E:
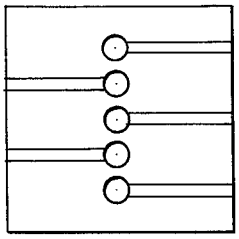
Figure 5F:
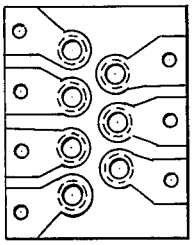

Structures appropriate for use as apertured masks within the context of the present invention are shown in FIGS. 5A–5F. A simple pinhole and slot in thin metallic sheet material are illustrated in FIGS. 5A and 5B, respectively. The pinhole mask is used to generate a single dotted, dashed, or solid line image. A slotted mask finds application in the generation of printed bars. These can of course be of any arbitrary width depending on the width of the mask aperture, the motion of the charge receptor under the mask, and the gating timing sequence. A linear array of printing apertures is shown in FIG. 5C. This structure is formed by embedding a set of fine parallel wires in an insulating binder film. The wires are not equally spaced but are alternately closer together and farther apart. Printing apertures indicated as squares in FIG. 5C are left open between pairs of spaced apart wires. The two wires adjacent to each aperture are connected electrically and are driven to produce the ion switching action at each gating channel. Another printing aperture linear array is shown in FIG. 5D. This array is fabricated by bonding apertured thin metallic strips in a planar array with hardenable insulating adhesive material. The gating masks illustrated in FIGS. 5A, 5B, 5C and 5D may all be described as unsupported, planar structures. Masks which are supported and aplanar are also useful in the present printer. These may be made using photomasking and selective etching techniques standard to the electronics industry. The resulting structures comprise shaped thin metal foil electrodes laminated to organic polymer films or fiberglass reinforced epoxy sheet material. Aplanar characteristics have to do with through-hole plating and electrically connected pads on opposite faces of the insulating support material. Masks of this type are shown in FIGS. 5E and 5F. Their aplanar characteristics are further illustrated in FIGS. 6C and 6D. The mask of FIG. 5F is of the staggered array type useful for example in developing a cosmetic degree of overlap of the image structural elements in dot matrix printing. FIGS. 5A to 5F are not intended to represent a complete cataloging of the mask configurations appropriate for aperture printing in the present invention. Further structural features of such masks are shown in FIGS. 6A through 6D.

Figure 6A:
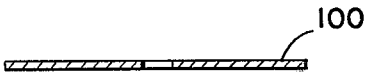
FIGS. 6A through 6D are cross-sectional views of ion gating members including specially shaped projections which enhance the ion transmission.
Figure 6B:
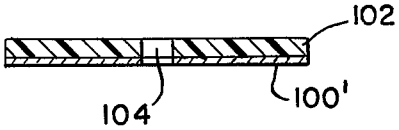

Cross sectional representations of various aperture mask types are illustrated in FIGS. 6A through 6D. A simple planar metal sheet 100 comprises the unsupported planar mask shown in FIG. 6A. FIG. 6B illustrates a supported planar mask consisting of metallic foil 100' bonded to a more rigid insulating film 102. The structure of the aperture 104 in the latter mask may be similar to that of multilayer charged particle flow modulating apertures defined by Burdige in U.S. Pat. No. 3,582,206 issued June 1, 1971; McFarlane et al. in U.S. Pat. No. 3,645,614 issued Feb. 29, 1972; Pressman et al in U.S. Pat. No. 3,647,291 issued Mar. 7, 1972 and Pressman in U.S. Pat. No. 3,694,200 issued Sept. 26, 1972. Their modulating apertured screens operate to control the flow of ions or charged toner or ink particles by means of electric fringing fields established along the open length of the compound apertures. This process is entirely distinct from the operating philosophy of the present invention wherein ion control is effected via the establishment of collection or blocking fields between one or more apertures and a charge receptor backing electrode. The ion gating operating principles discussed in this disclosure will also be recognized as being entirely different from the use of lateral diverting fields for control purposes such as described in U.S. Pat. No. 3,594,162 issued July 20, 1971 to Simm et al.

Figure 6C:
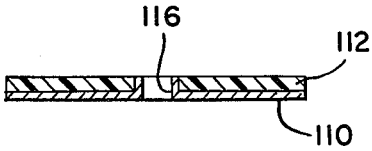
Figure 6D:
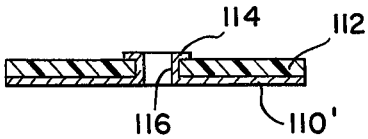

FIGS. 6C and 6D show supported masks incorporating structural improvements which enhance their electrostatic aperture printing performance. In both cases a thin layer of metallic electrically conductive material 116 is attached to the walls of the openings through the insulating support material 112. The mask of FIG. 6D exhibits additionally a conductive lip region 114 contiguous with the through-hole conductor 116. These masks may be conveniently constructed using standard printed circuit techniques. Two sided polyester film based circuit board stock is especially appropriate for the support material. Mask and lip structures may be selectively etched using photoresists. Relevant conductors on opposite sides of the insulating support are then suitably connected by electroless plating. In this context the mask of FIG. 6D is representative of an electrically ruggedized version of the mask of FIG. 6C. Operation of the former involves ion impingement predominantly on the durable laminated foil lip 114 rather than the more fragile region of through-hole plating 116. To simplify the discussion of their operating features ion gating masks each having a single aperture are illustrated in FIGS. 6A to 6D. Clearly more complicated masks addressed to a variety of specific printing applications can operate on the principles FIGS. 6A to 6D are intended to illustrate. (For example, FIGS. 5E and 5F have been drawn with the intention that they be associated with FIGS. 6C and 6D respectively.) Again FIGS. 6A to 6D are not intended to represent all aperture structures which will be found compatible with operation according to the teachings of the present invention.

Figure 7A:
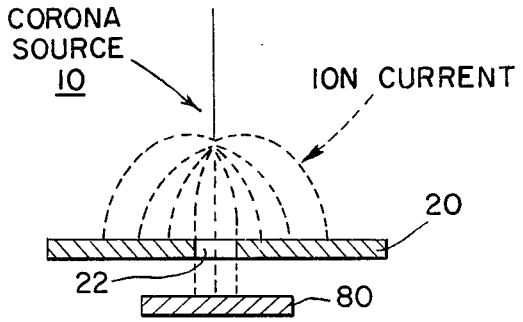
FIGS. 7A through 7C depict ion current distribution from a point source to a simple and compound control mask indicating the enhanced transmission of the latter.
Figure 7B:
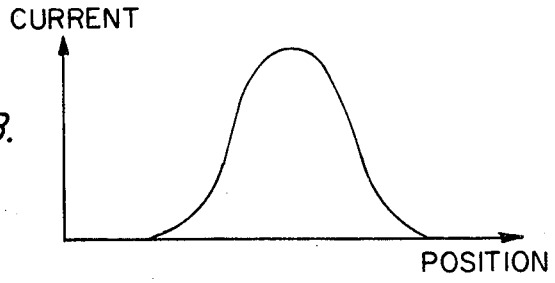
Figure 7C:
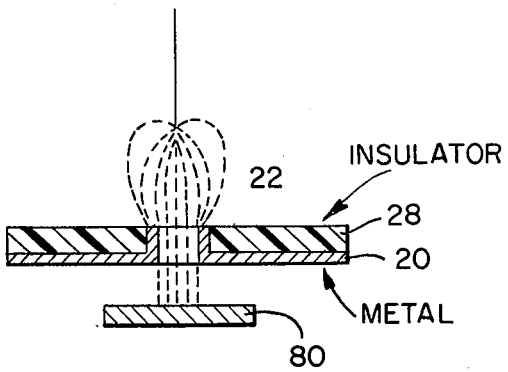

FIG. 7A like FIG. 1 shows a corona emitting point source of ions 10, a simple (single conducting component) mask 20 with an aperture 22, and a charge receiving probe 80 to monitor the ion current flow through the mask aperture. The probe is configured to take the place of the dielectric receptor sheet and its backing electrode normally employed in aperture printing. As a practical matter in a given aperture printing setup, the backing electrode fitted with appropriate current measuring means such as an electrometer can itself function as the current sampling probe electrode. The dashed lines drawn in FIG. 7A are intended to represent the interelectrode flow of ions for this system. If the apertured mask is displaced laterally (perpendicular to the symmetry axis of the electrode system), the values of transmission current plotted as a function of aperture position yield a curve of the form shown in FIGS. 7B. The exact shape of the current-position profile depends on aperture size, depth-width aspect ratio of the aperture, the separation of the corona source 10 and the aperture mask 20, corona excitation conditions, and collection conditions (probe-to-mask biasing). Maximum transmission occurs when the mask aperture is centered immediately below the corona source as shown in FIG. 7A. In any given electrostatic aperture printing application the ion transmission of the mask aperture or apertures is related to the maximum rate at which useful charge imagery can be generated. These parameters are inversely proportional—the higher the transmission the shorter the time required to form a given charge image. Ion transmission may or may not represent a fundamental limitation in practice. Constraints associated with image toning and fusing procedures must also be considered. There are approaches to aperture printing where increased transmission of the gating electrodes would always be beneficial (especially if corona sources are employed). Multiplexing — time sharing of excitation or control switching means to realize significant hardware parts count economies — is an example. It is therefore a further object of this invention to specify means to significantly increase the ion transmission of electrostatic aperture printing masks. FIG. 7C shows the same aperture printing electrode system as FIG. 7A except that insulating or dielectric material 28 is substituted for most of the upper portion of the gating mask. During operation of the corona source the exposed surface of the insulator receives and accumulates ions. This raises the potential of the upper surface of the mask relative to its conducing portions and alters or reshapes the electric field between the ion source and the control mask. Charge buildup on the dielectric surface continues only until additional corona ions are repelled and prevented from reaching the charged insulator. At this point the stable situation indicated in FIG. 7C has been reached wherein all the ions generated by the corona source either impinge on the ring of through-hole plating material or pass entirely through the mask aperture 22 to be collected at the transmission current sampling probe 80. One expects the total ion emission of the corona source to decrease with the arrangement of FIG. 7C. But at the same time the efficiency with which these ions are utilized (passed through the mask aperture to contribute to the charge image) increases more dramatically. The result is an overall net increase in the transmission current available.

Figure 8:
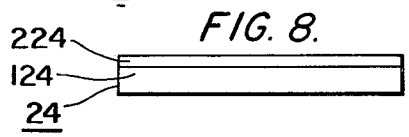
FIG. 8 is a fragmentary view in section of a dielectric charge receiving member.

As shown in FIG. 8 charge receptor sheet 24 or 24' (FIG. 1, FIG. 2) comprises a moderately conducting base layer 124 and a thin insulating layer 224 bonded thereto.

FIG. 9 illustrates an ion generating means wherein ions are generated by a decoupled arc discharge, using a step-up pulse transformer T actuated by low voltage switching means S to discharge a capacitor C into the primary winding W of said transformer.

The utility of the present invention has been evaluated by means of breadboards and a preproduction prototype in which masks containing 15 mil diameter apertures were tested for the generation of one-eighth inch high 5 by 7 dot-matrix characters. The masks employed included simple 5 mil thick conducting masks such as those shown in FIGS. 5A, 5B, and 6A; and 15 mil thick supported masks such as those shown in FIGS. 6B, 6C, and 6D. Corona points or wires as well as arcs were found to be suitable ionization sources. Satisfactory results were obtained using ion emitters constructed from 2 mil diameter corona wire placed 25 to 100 mils above the gating mask. Corona voltages (wire or point to mask) in the range 2 to 5 kilovolts were successfully employed. The gating mask was spaced from 5 to 10 mils above the charge receptor sheet. Sharp focusing of positive ions was readily realized by biasing the control mask from 200 to 400 volts more positive than the receptor backing electrode. The flow of ions through the mask was found to be blocked entirely by making the mask 25 to 50 volts lower in potential than the backing electrode. Throughput velocity of the dielectric paper charge receptor sheet was 3 inches per second for evaluation purposes. Charge image spot sizes ranging from somewhat smaller to several times larger than the actual mask aperture dimensions were achieved.

We claim:

1. An electrostatic printer comprising:

a dielectric charge receiving member, a source of ions constrained to move in the electric fields provided for their generation transport and collection;

at least one apertured mask interposed between said ion source and said dielectric charge receiving member and wherein said mask comprises at least one aperture and the same number of discrete conducting segments, and an insulating support member wherein the aperture walls of which are rendered conducting by attached through-hole conductors in order to enhance the ion transmission of the mask:

a backing electrode constituting a non-vacuum close electrical contact to the entire contact surface of said receiving member to control in cooperation with said mask or masks the flow of ions from said source to said dielectric charge receiving member;

means to transport said dielectric charge receiving member in concert with operation of a charge flow modulation means;

means for supporting and establishing an electric potential at the back side of said dielectric charge receiving member;

circuit means for introducing appropriate image structure related control voltage pulses to the modulating means;

means for toning or developing the charge image record to a visually observable state;

means for fusing or fixing the developed imagery to a stable, semipermanent operation; and means for the ejection or delivery of the finished graphic record.

2. An electrostatic printer as described in claim 1 wherein said source of ions comprises a single voltage source connected to a corona wire, a corona point, wires or points arranged to be electrically common, or multiplets of wires or points the elements of which are decoupled one from another by series resistors.

3. An electrostatic printer as described in claim 1 wherein said ions are generated by one or more decoupled arc discharges initiated using a single pulse transformer activated by employing low voltage switching means to discharge a capacitor into the primary winding of said transformer.

4. An electrostatic printer as set forth in claim 1 wherein said apertured mask is interposed between the ion source and said dielectric charge receiving member and consists of a single conducting sheet, having at least one pinhole or extended slot opening for generating a dotted, dashed, or solid line or lines, or bars of fixed length and variable width.

5. An electrostatic printer as set forth in claim 1 wherein said apertured mask is interposed between said ion source and said dielectric charge receiving member and consists of discrete conducting segments adjacent to or surrounding each of a number of apertures configured in a single linear array or two or more staggered, parallel linear arrays suitable for the generation of dot-matrix imagery.

6. An electrostatic printer as set forth in claim 1 wherein the apertured control mask is further electrically ruggedized by termination of the through-hole conductors in slender conducting pads which surround each aperture and face the ion source.

7. An electrostatic printer as described in claim 1 wherein the dielectric charge receiving member comprises a moderately conducting base layer and a thin insulating layer bonded thereto.

8. An electrostatic printer as described in claim 1 wherein the backing electrode for the charge receiving member is a static, conducting structure exhibiting a zone of positive cylindrical curvature at least a part of which is configured to contact the dielectric charge receiving member so that reaction forces to the web tension develop in the contact zone a positive hold-down pressure urging the charge receptor into supportive proximity with the backing electrode.

9. An electrostatic printer as set forth in claim 1 wherein charge image generation multiplexing is achieved by addressing in common corresponding elements of multiple mask gating aperture sets and selecting the set or sets which will actually print by means of enabling logic which establishes a blocking potential on all but one or more backing electrode segments while the remaining channel or channels are rendered transmitting to allow the number of drivers and logic channels needed to print $m$ rows or columns of characters having $n$ rows or columns of character structure elements to be reduced from $m$ times $n$ to $m$ plus $n$.

10. An electrostatic printer as described in claim 1 wherein the backing electrode for the charge receiving member comprises a conductive circular cylinder mounted to allow rotation about its geometrical axis and located to provide a zone of contact between itself and the dielectric charge receiving member such that reaction forces to the web tension develop a positive and uniform holddown pressure urging the charge receiving member into supportive proximity with the backing roller.

11. An electrostatic printer as described in claim 10 wherein said backing electrode is further a transport roller allowing longitudinal displacement of the receptor web to permit the generation of imagewise charging area coverage.

12. An electrostatic printer as set forth in claim 1 wherein the ion source conditions are fixed and including means to bias the apertured mask or masks to a constant potential, and means for switching the backing electrode between voltage levels corresponding to ion transmission and blocking, whereby charge modulation or gating is achieved.

13. An electrostatic printer as set forth in claim 12 wherein the backing electrode is segmented into a number of electrically isolated sections each of which is independently biasable to permit the control of a number of printing channels.

* * * * *